US009926652B2

(12) United States Patent
King

(10) Patent No.: US 9,926,652 B2
(45) **Date of Patent: *Mar. 27, 2018**

(54) WIRED KERNMANTLE

(71) Applicant: Jarod Lee King, Ceres, CA (US)

(72) Inventor: Jarod Lee King, Ceres, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/346,872

(22) Filed: Nov. 9, 2016

(65) Prior Publication Data

US 2017/0051441 A1 Feb. 23, 2017

Related U.S. Application Data

(63) Continuation-in-part of application No. 14/604,718, filed on Jan. 24, 2015, now Pat. No. 9,528,204.

(51) Int. Cl.

| | |
|---|---|
| ***D04C 1/12*** | (2006.01) |
| ***A44C 5/00*** | (2006.01) |
| ***D04D 1/02*** | (2006.01) |
| ***D03D 1/00*** | (2006.01) |
| ***D04C 1/02*** | (2006.01) |

(52) U.S. Cl.

CPC ..... *D04C 1/12* (2013.01); *A44C 5/0007* (2013.01); *A44C 5/0053* (2013.01); *D03D 1/00* (2013.01); *D04C 1/02* (2013.01); *D04D 1/02* (2013.01)

(58) Field of Classification Search

CPC ..... A44C 5/0007; A44C 5/0053; D04D 1/02; D04C 1/12

See application file for complete search history.

(56) References Cited

U.S. PATENT DOCUMENTS

| | | | | |
|---|---|---|---|---|
| 4,640,179 | A * | 2/1987 | Cameron | D04C 1/02 57/210 |
| 4,819,914 | A * | 4/1989 | Moore | A01K 3/005 174/124 |
| 5,809,861 | A * | 9/1998 | Hummel | D02G 3/442 57/230 |
| 7,546,724 | B2 * | 6/2009 | Wang | A63B 51/02 57/210 |
| 8,484,941 | B2 * | 7/2013 | Malafaya Oliveira Sa | D07B 1/005 57/230 |
| 8,925,348 | B2 * | 1/2015 | Gagne | A44C 5/0007 63/1.12 |
| 9,021,664 | B2 * | 5/2015 | Ingalls | F16G 11/00 24/115 R |
| 9,084,455 | B2 * | 7/2015 | Millan | B26B 9/00 |
| 9,528,204 | B2 * | 12/2016 | King | D04C 1/12 |
| 2005/0109008 | A1 * | 5/2005 | Kuo | D07B 1/162 57/230 |

(Continued)

*Primary Examiner* — Shaun R Hurley

(74) *Attorney, Agent, or Firm* — Richard Brewster Main; Main Law Cafe

(57) ABSTRACT

A wired kernmantle cord comprises a single continuous length of 20-30 AWG solid, stranded, or braided metal wire coaxially placed in the center of a bundle of seven nylon yarns. The seven yarns each comprise three twisted nylon fibers. The metal wire and the seven yarns thus form a kern that is sheathed inside a woven, braided outer mantle of nylon. The mantle sheathing is woven densely and tightly enough to keep the kern from appearing or working through, and it provides electrical insulation for the metal wire, and weather and abrasion resistance and other environmental protection for the whole.

6 Claims, 6 Drawing Sheets

(56) References Cited

U.S. PATENT DOCUMENTS

| | | | | |
|---|---|---|---|---|
| 2013/0031935 | A1* | 2/2013 | Kelleghan | A44C 5/00 63/1.12 |
| 2013/0167502 | A1* | 7/2013 | Wilson | B29C 70/025 57/210 |
| 2013/0189631 | A1* | 7/2013 | Mojica | F23Q 1/06 431/274 |
| 2013/0213089 | A1* | 8/2013 | Gagne | A44C 5/0007 63/1.12 |
| 2014/0026371 | A1* | 1/2014 | Ingalls | F16G 11/00 24/115 R |
| 2014/0178615 | A1* | 6/2014 | Broadway | D03D 3/00 428/35.5 |
| 2015/0282571 | A1* | 10/2015 | Gendron | A44C 5/0007 206/372 |
| 2016/0166012 | A1* | 6/2016 | Mojica | A44B 11/005 24/591.1 |

* cited by examiner

WIRED KERNMANTLE

FIELD OF THE INVENTION

The present invention relates to kernmantle cord, and more particularly to 550-type Paracord that includes survivalist utility wire.

DESCRIPTION OF THE PRIOR ART

Various bits of wire can be a lifesaver in a survivalist situation. Some of us may find ourselves thrust into desperate outdoor situations far from home or other people unprepared and underequipped. That will mean you'll only have what you are carrying at the time to survive against the Elements.

Survivalists and outdoor adventurers make conscious efforts to equip themselves with dual-purpose items. True survivalists look for ways to reduce the weight of the things they carry, and items that have dual purposes are very good in this respect. Some problems they will encounter are easy to expect, others will be surprises and therefore unwelcomed challenges, especially if they're not equipped to deal with the issues. First aid kits are a common way to prepare and equip for a variety of small medical emergencies. The spare tires, bumper jacks, and lug wrenches in cars are another way for motorists to get themselves out of trouble on the road.

So-called "550-Paracord" is a small diameter, very flexible synthetic-fiber (nylon/polyester) rope that has found wide appeal because of its many surprising uses, e.g., zipper pulls, handles, keychains, bracelets, lanyards and emergency lashing. The "550" implies it has a breaking strength of 550-pounds. Other ratings are also in popular use. These all have a "kernmantle" construction which is German for a woven outer sheath with a core inside of twisted inner yarns of continuous fiber.

It was originally used for the downward suspension cords in military grade parachutes, and so many 550-Paracords are offered in a MIL-STD-C-5040H grades and even quality commercial grades. The braided sheaths have a high number of interwoven strands for their rope size, making for a relatively smooth texture. All-nylon construction makes 550-Paracord moderately elastic. Genuine MIL-SPEC MIL-C-5040 Type III Paracord has 7-9 inner yarns each of up three strands.

Technical Standard MIL-C-5040H

| Type | Minimum strength | Minimum elongation | Minimum length per pound | Core yarns | Sheath structure |
|---|---|---|---|---|---|
| I | 95 lb (43 kg) | 30% | 950 ft (290 m; max. 1.57 g/m) | 1 | 16/1 |
| IA | 100 lb (45 kg) | 30% | 1050 ft (320 m; max. 1.42 g/m) | <no core> | 16/1 |
| II | 400 lb (181 kg) | 30% | 265 ft (81 m; max. 5.62 g/m) | 4 to 7 | 32/1 or 36/1 |
| IIA | 225 lb (102 kg) | 30% | 495 ft (151 m; max. 3.00 g/m) | <no core> | 32/1 or 36/1 |
| III | 550 lb (249 kg) | 30% | 225 ft (69 m; max. 6.61 g/m) | 7 to 9 | 32/1 or 36/1 |

-continued

Technical Standard MIL-C-5040H

| Type | Minimum strength | Minimum elongation | Minimum length per pound | Core yarns | Sheath structure |
|---|---|---|---|---|---|
| IV | 750 lb (340 kg) | 30% | 165 ft (50 m; max. 9.02 g/m) | 11 | 32/1, 36/1, or 44/1 |

Paracord Bracelets are now very popular amongst "preppers" who see it to be important to have a basic toolkit of gear always with them. Paracord is even being woven into belts and rifle slings, ready to be used when least expected.

The nylon yarns of 550-Paracord, "the guts", can be removed when a finer thread is needed, for instance as sewing thread to repair gear, fishing line, and medical wound sutures in a survival situation. The nylon sheath can be used alone after the yarn in the core is removed when a thinner or less elastic cord is needed for boot lace and similar needs. The naturally frizzy ends of the cord are habitually melted with a match and hot-crimped to prevent excessive unraveling. In fact, larger melts from the nylon cord can be used as water-sealing plugs in various equipment needing repairs.

SUMMARY OF THE INVENTION

Briefly, a wired kernmantle cord embodiment of the present invention comprises a single continuous length of 20-30 AWG solid, stranded, or braided metal wire coaxially placed in the center of a bundle of seven nylon yarns. The seven yarns each comprise three twisted nylon fibers. The metal wire and the seven yarns thus form a kern that is sheathed inside a woven, braided outer mantle of nylon. The mantle sheathing is woven densely and tightly enough to keep the kern from appearing or working through, and it provides electrical insulation for the metal wire, and weather and abrasion resistance and other environmental protection for the whole.

These and other objects and advantages of the present invention no doubt become obvious to those of ordinary skill in the art after having read the following detailed description of the preferred embodiments which are illustrated in the various drawing figures.

IN THE DRAWINGS

Figure 1A:
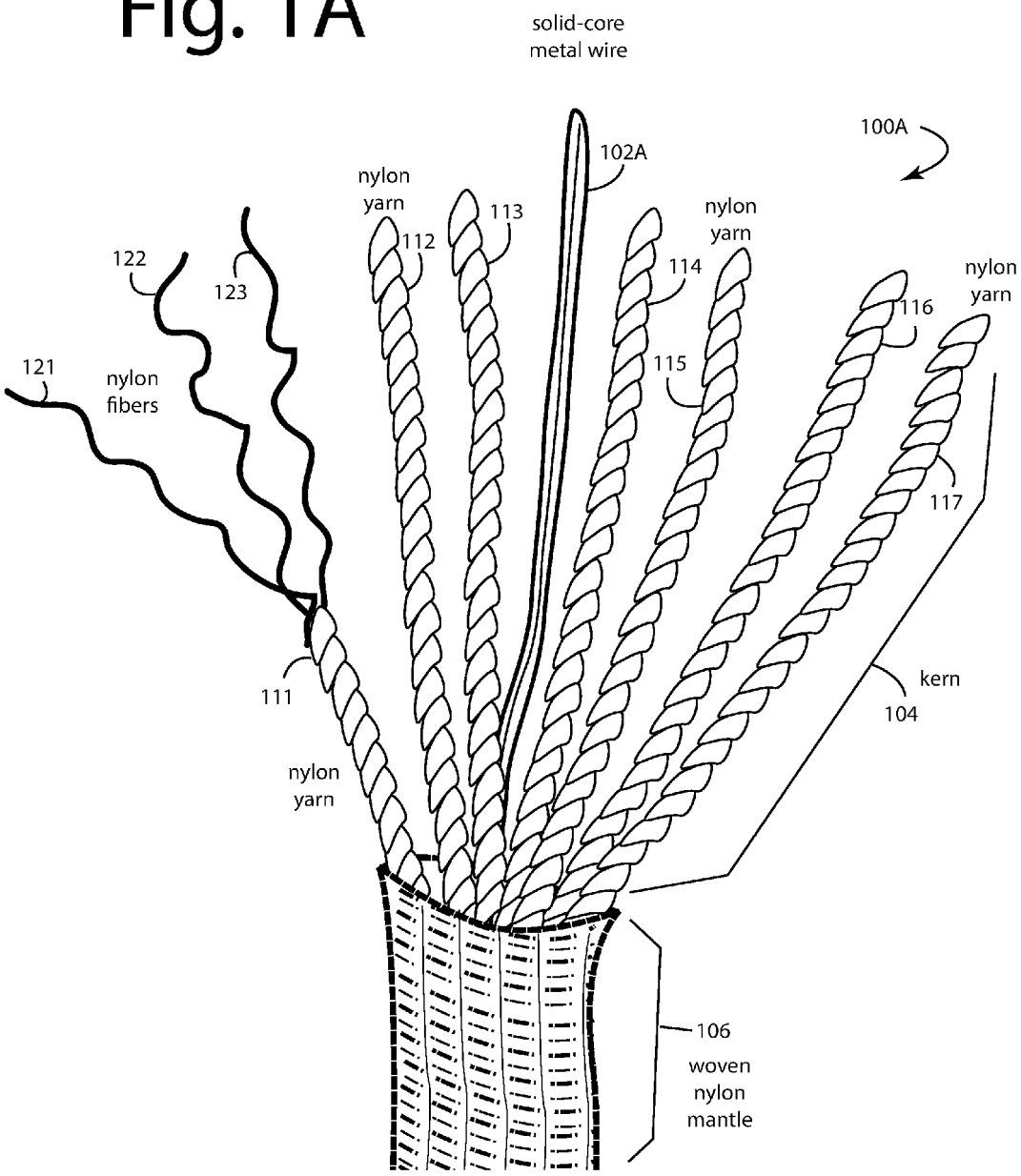
FIG. 1A is a perspective view diagram of a wired kernmantle cord of the present invention in which the coaxial wire at the center is a solid-core of metal.
Figure 1B:
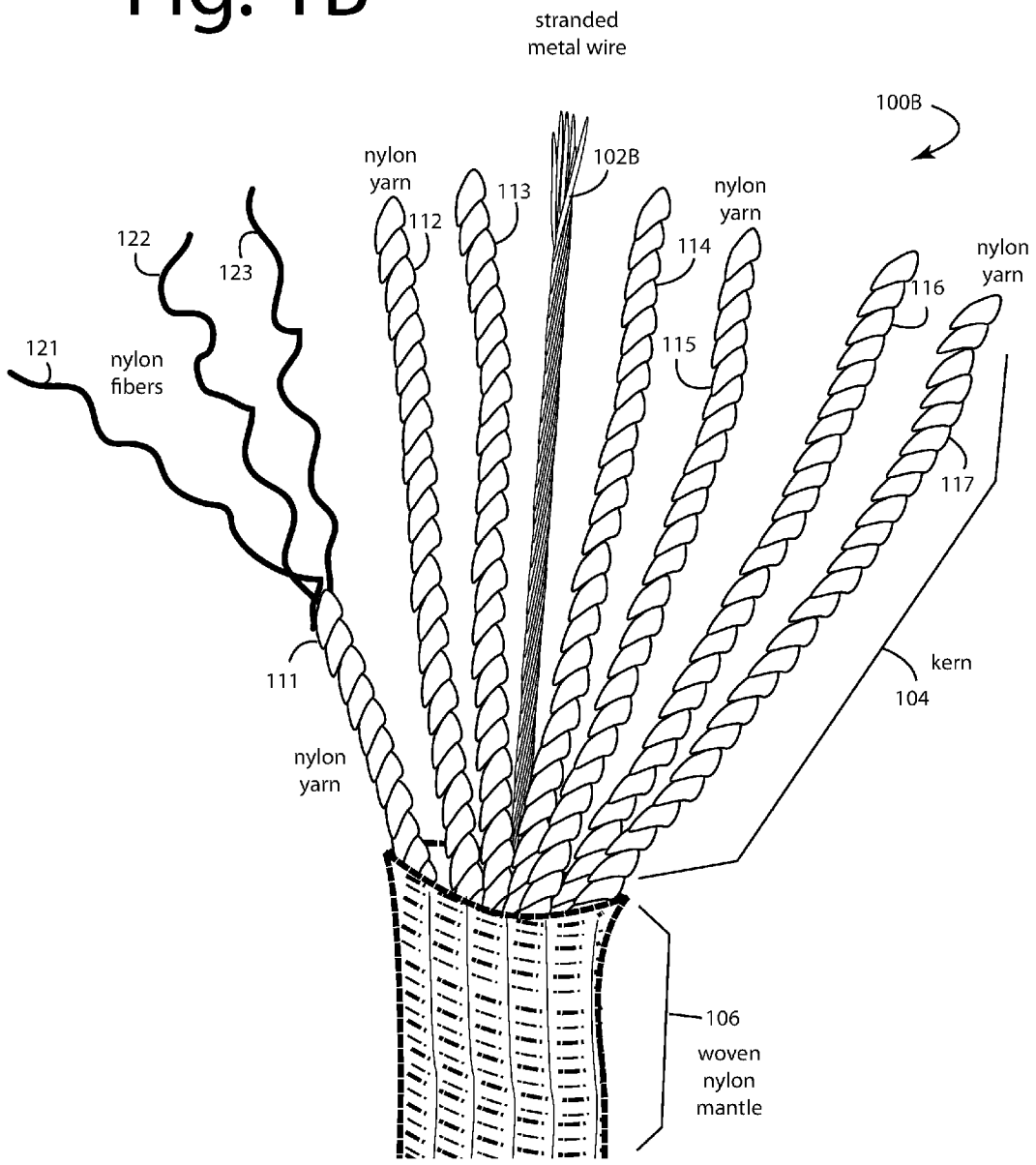
FIG. 1B is a perspective view diagram of a wired kernmantle cord of the present invention in which the coaxial wire at the center is a metal multi-strand.
Figure 1C:
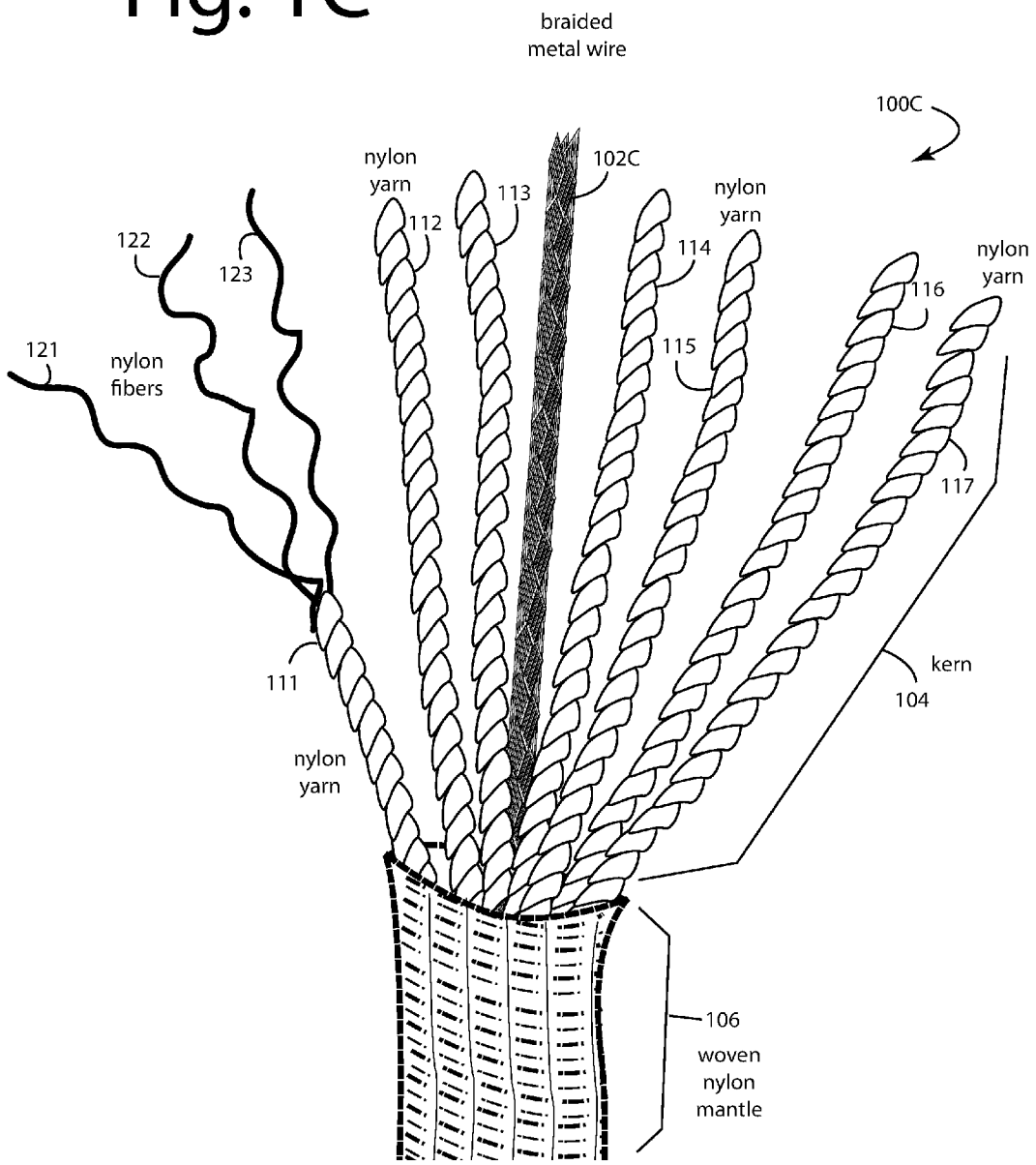
FIG. 1C is a perspective view diagram of a wired kernmantle cord of the present invention in which the coaxial wire at the center is a metal braid.
Figure 2:
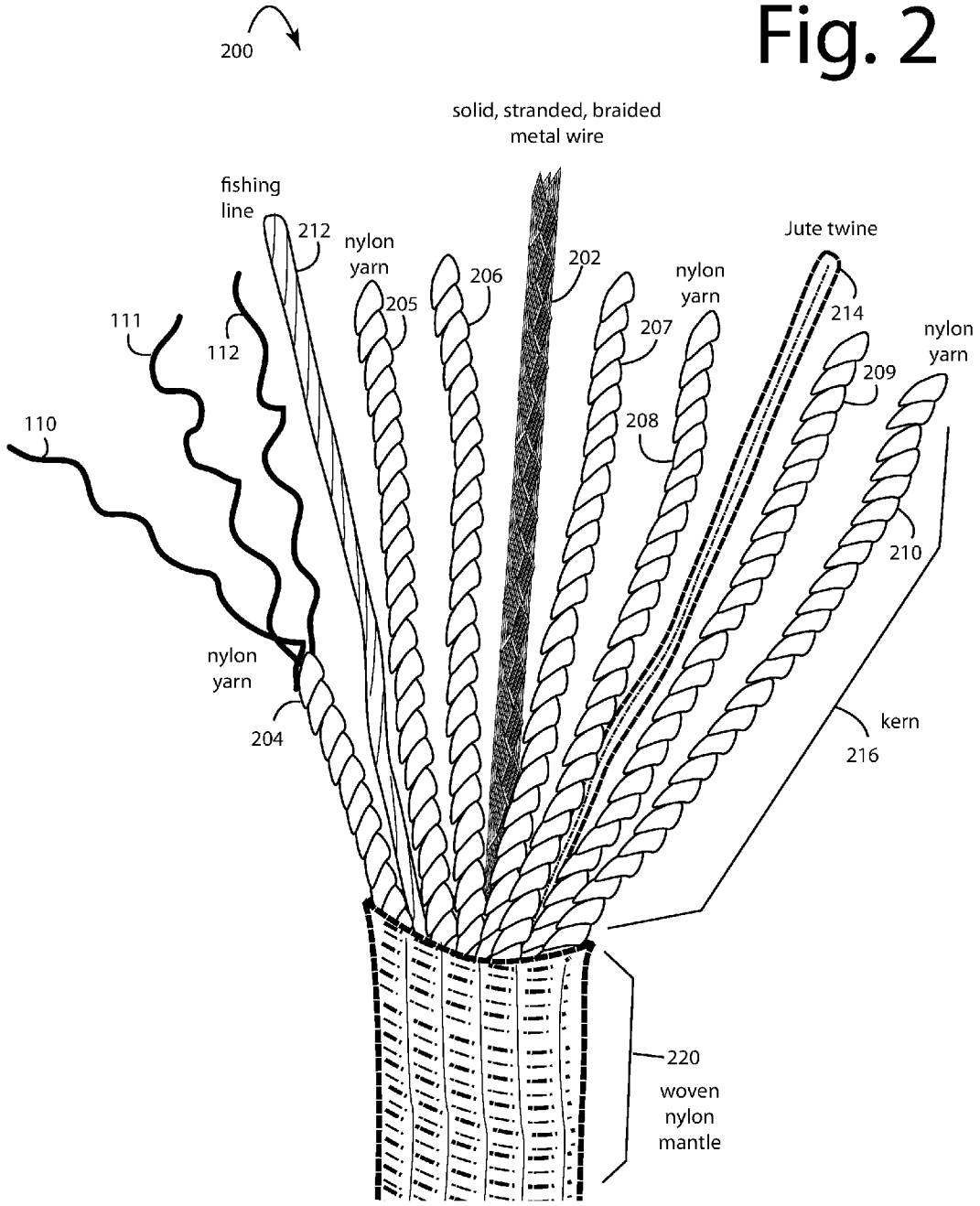
FIG. 2 is a perspective view diagram of a wired kernmantle cord of the present invention in which the coaxial wire at the center is a metal braid, and in which a braided fishing line and a Paraffin-waxed Jute twine are further included in the kern.
Figure 3A:
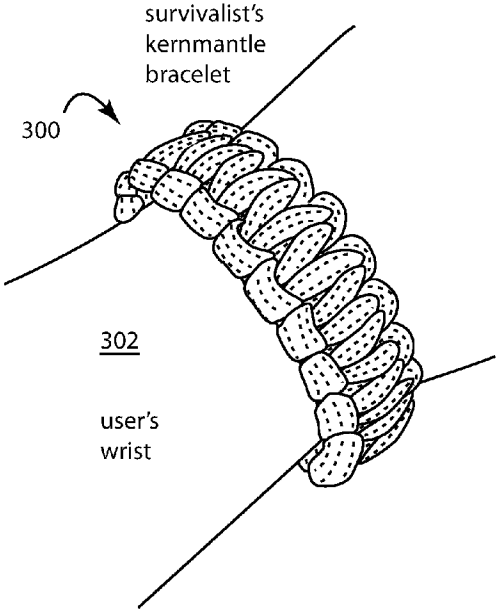
Figure 3B:
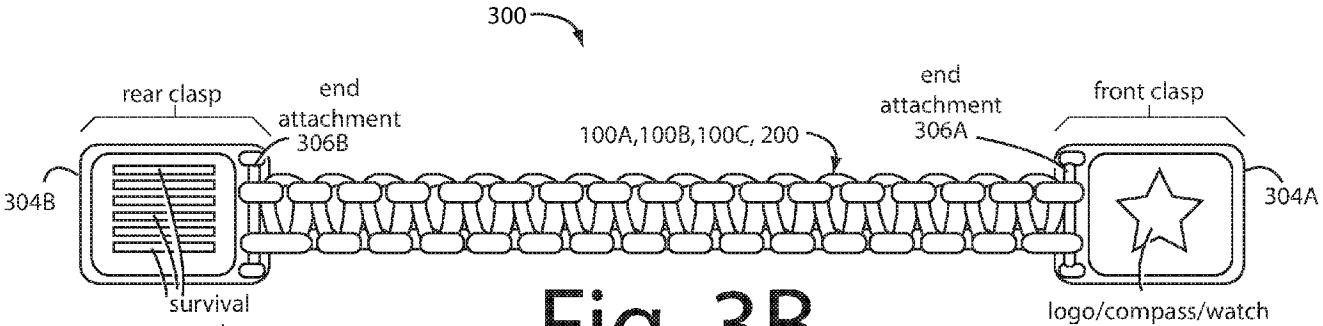
Figure 4:
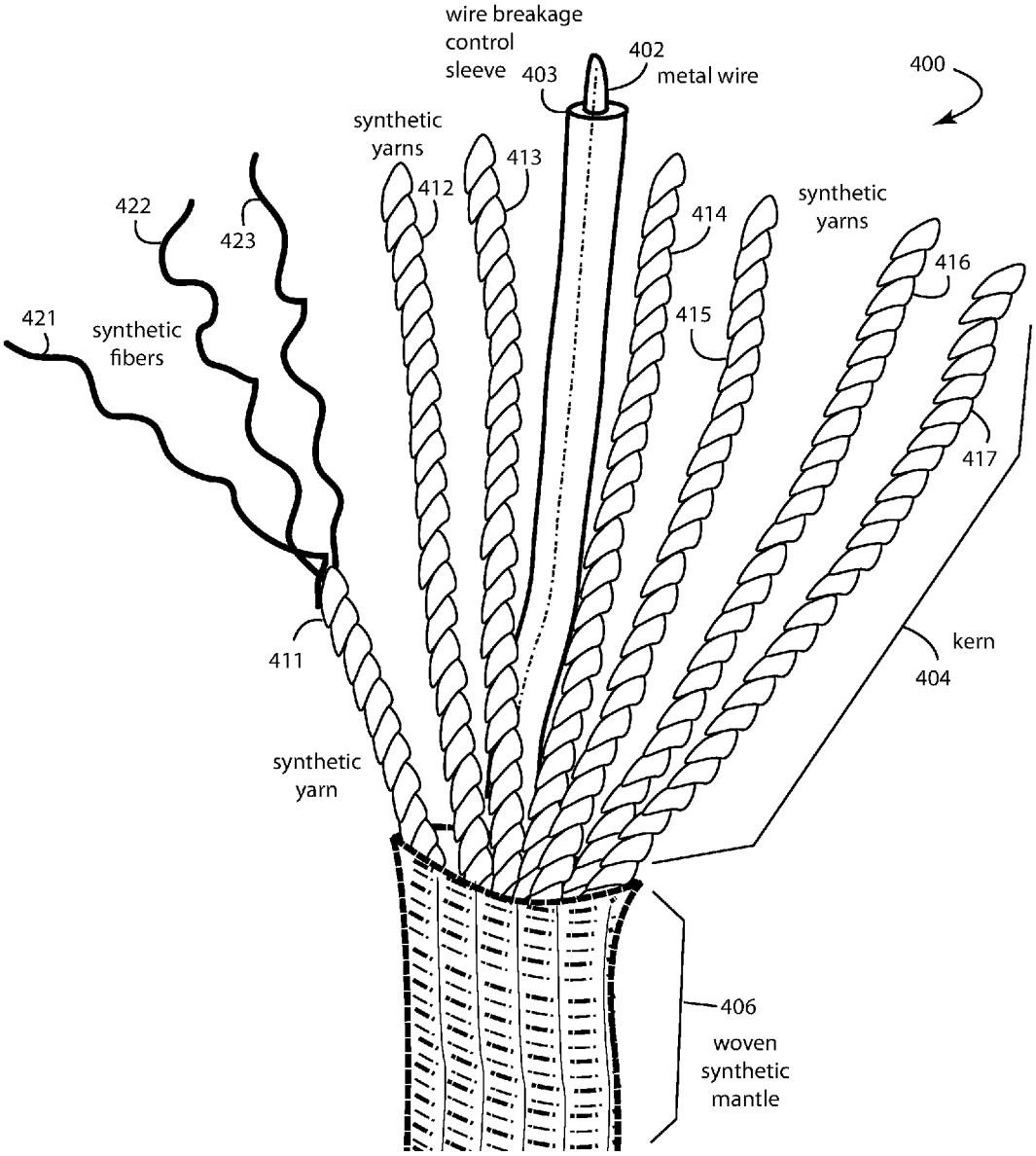

FIGS. 3A and 3B are a perspective view and a top view a paracord bracelet embodiment of the present invention that has been woven from a single strand of the improved kernmantle cord of FIG. 1A, 1B, 1C, or 2; and FIG. 4 is a perspective view diagram of a wired kernmantle cord of the present invention in which the coaxial wire at the center is sleeved to control mechanical excursions of any broken wire ends within.

DETAILED DESCRIPTION OF THE PREFERRED EMBODIMENT

FIG. 1A represents a first wired kernmantle cord embodiment of the present invention, and is referred to herein by the general reference numeral 100A. A 20-30 AWG solid-core metal wire 102A is disposed coaxially in the center of a kern 104 of seven nylon yarns 111-117. Each yarn 111-117 comprises three twisted nylon fibers 121-123. The kern 104 is environmentally protected by a woven nylon mantle 106. The mantle 106 provides both abrasion resistance, and electrical insulation for the metal wire. It being woven allows the mantle to be very flexible, to the point of being floppy with no "memory" and no tendency to retain kinks.

Nylon was the original material used in the so-called military 550-Paracord that was manufactured to MIL-STD-C-5040H Type III. Very acceptable alternative synthetic fibers include polyester and Dyneema®, which is an ultra-high-molecular-weight polyethylene (UHMWPE, UHMW), and is a subset of the thermoplastic polyethylene. These can look exactly like nylon.

FIG. 1B represents a second wired kernmantle cord embodiment of the present invention, and is referred to herein by the general reference numeral 100B. A 20-30 AWG stranded metal wire 102B is disposed coaxially in the center of kern 104.

FIG. 1C represents a third wired kernmantle cord embodiment of the present invention, and is referred to herein by the general reference numeral 100C. A 20-30 AWG braided metal wire 102C is disposed coaxially in the center of kern 104.

Wires 102A, 102B, and 102C all share similar characteristics that are common to the metals they are fabricated from. They all exhibit relatively high melting points, high enough that the wire can be used to hold food in a flame for cooking. They all exhibit varying degrees of electrical conductivity, enough to support direct current (DC) power from batteries and radio frequency (RF) transmissions from communications transceivers. The wires, because of their constituent metals, also have varying degrees of corrosion resistance and chemical reactivity. And some metals formed into wires are more flexible than others and more resistant to metal fatigue. Brass and stainless steel alloys appear to be particularly useful metals in these applications here.

Conventional wire has many modern uses, and comes as solid wire, stranded, and braided. Nickel-plated copper, gold-plated copper, pure silver, pure nickel, gold alloys, Monel, bronze, and more are all very useful metal materials for wire. Solid wire, aka solid-core or single-strand wire, is one piece of gauge rated metal wire. Solid wire is useful for wiring, and is cheaper to manufacture than stranded wire. It is best used where there will be no flexing. Solid wire has relatively less surface area compared to other types, and resists corrosion better and longer. Corrosives and other agents in the environment have less of a surface to attack.

Stranded wire, on the other hand, is fabricated as a bundle small wires wrapped together in the electrical equivalent of a much larger diameter single conductor. Best of all, stranded wire is much more flexible and tolerant of flexing than is solid wire of the same total cross-sectional area. Stranded wire tends also to be a better conductor than solid wire, because a greater surface area results from adding together all the individual wires. Stranded wire is used where a higher resistance to metal fatigue is required. E.g., connections between circuit boards in multi-printed-circuit-board devices, where rigid solid wire interconnections can put too much stress on solder joints and terminals as a result of movement during assembly or servicing. Typical everyday uses of stranded wire include line cords for appliances, musical instrument cables, computer-mouse cables, welding electrode cables, control cables connecting moving machine parts, mining machine cables, trailing machine cables, etc.

Stranded wire always has a slightly larger diameter in the same equivalent gauge compared to solid wire. A stranded wire will have higher resistance than a solid wire of the same diameter because the cross-section of the stranded wire is not all copper. There are unavoidable gaps between the strands.

Better performance at high frequencies can be obtained with so-called Litz wire, which has its individual strands insulated and twisted in special patterns. A so-called "skin effect" occurs in wire at high frequencies of alternating current (AC). The bulk of the AC current travels nearer the surface of the wire as the AC frequencies increase, wasting any conductor material in the core. Ordinary stranded wire might seem to not suffer this effect, since the total surface area of the strands is greater than the surface area of the equivalent solid wire. But ordinary stranded wire does not actually reduce the skin effect in combination because the strands all short-circuit together and behave as a single conductor.

Stranded wire does better controlling the so-called Proximity Effect, which is the tendency for current to flow in undesirable eddy patterns, loops or concentrated distributions. Magnetic fields induced by nearby conductors can cause this effect. In many high-frequency applications, the Proximity Effect is more severe than the Skin Effect.

Braided wire has its small strands of wire braided together. Braided wires are also better conductors than solid-core wire. And braided wires tolerate flexing much better. Braided wires find uses as the outer sheathing or mantle in electromagnetic shield noise-reduction cables. The more individual wire strands there are in a wire bundle, the more flexible, kink-resistant, break-resistant, and stronger the wire will become. But, more strands increases manufacturing complexity and cost.

Because of geometry, the least number of useful strands is seven, one in the middle, and six surrounding it in close contact. The next level up is nineteen, which is another layer of twelve strands on top of the first seven. After that, the conventional number of strands varies, but thirty-seven and forty-nine are common, then up to 70-100. Larger numbers of strands than that are rare.

In applications where the wire will be moved, nineteen is a minimum. Seven strands should only be used in applications where once the wire is placed it is not moved again. Forty-nine standards is much better. In applications with repeated movement, such as assembly robots and headphone wires, 70-100 strands is mandatory.

For applications that need even more flexibility, hundreds more strands are used, e.g., as in welding cables. One example is a 2/0 wire made from 5,292 strands of #36 gauge wire. The strands are organized by first creating a bundle of seven strands. Then seven of these bundles are formed together into super bundles. Finally, one hundred and eight super bundles are combined to make a finished cable. Each group of wires is best wound in a helix so that when the cable is flexed, the parts that stretch and compress shift around the helix to distribute the flexing stresses more evenly.

Mantle 106 represents an improved woven synthetic-thread sheathing that is widened over conventional constructions and supplemented with additional threads. Such allows the improved mantle 106 to snugly accommodate all the elements of the entire kern 104 without any of the kern showing or sticking through the mantle sheathing. Such maintains the environmental protection from abrasion while still being loose enough for the whole kernmantle cord to still be pliable.

Referring now to FIG. 2, alternative embodiments of the present invention further incorporate a braided fishing line and a Paraffin-wax impregnated Jute twine. For example, a survivalist kernmantle cord 200 has coaxially at its center, a solid, stranded, or braided wire 202, and a surrounding group of seven nylon yards 204-210. Added to this are a braided fishing line 212 and a Jute twine 214 for use as tinder when frayed. Together, all these ten constitute a kern 216.

An obvious variation here would be to change the number of nylon yarns, or to use different synthetic fibers other than nylon. What is described here is what we have found to be the best mode for making and using kernmantles 100 and 200.

Paraffin wax is widely used in candles and will help the Jute twine 214 to stay dry. The wax itself adds to the overall flammability when it melts and vaporizes at a flash point of 390° F.

The kern 216 is fully sheathed by a mantle 220 of woven synthetic-thread. Such mantle 220 fits snugly to accommodate all the elements of the entire kern 216 without any of the kern showing or being able to work through the mantle sheathing. The materials and construction of mantle 220 work together to maintain an environmental protection of kern 216 from environmental forces like weather and abrasion, and fit just loose enough for the whole survivalist kernmantle cord 200 to still be pliable. Mantle 220 may be of slightly larger outside diameter than conventional 550-Paracord because it is accommodating more elements inside.

The survivalist kernmantle cord 200 will be pliable because the nylon yards are soft and flexible, the mantle is woven, the Jute twine cord is soft, and the fishing line is braided. It will be the most pliable when the metal wire is also a braided type. A solid-core metal wire will increase stiffness, and may express a bending or kinking memory that may not be desirable.

The Jute twine 214 is a continuous thread waterproofed and paraffin-waxed. It is included for use as tinder to start campfires and cooking fires even in the rain. It can also be used as a makeshift candle that doesn't smell bad when burning. (Like kerosene-soaked wicks can.)

After experimenting with different kinds of fishing lines, and having our customers test them, we discovered that although clear monofilament fishing line is useful for fishing, anything over 25# test does not fit well within a standard paracord diameter. Monofilament fishing lines can also exhibit a memory characteristic which imparts to the survivalist kernmantle overall. Such will retain kinks after knots or sharp bends have been made, and such memory makes fly-cast fishing difficult.

Braided fishing line is relatively strong for its small diameter, and it has no stretch. Braided fishing line is much easier to use in fly-cast fishing because it's so pliable. Braided fishing line can also be used in a second-purpose survivalist role, that of a medical suture thread in an emergency.

Braided and monofilament fishing lines both can be melted into plastic plugs to patch small holes in kayaks or other small boats.

Braided line is one of the oldest kinds of fishing line, and remains very popular because of its high knot strength, lack of stretch, and high strength in relation to its diameter. Braided lines were originally made from natural fibers such as silk, cotton and linen, but natural fibers have long since been replaced by synthetic materials like Dacron, Spectra or micro-Dyneema. Braided fishing lines in general have good abrasion resistance, which is very important when fishing over rough ground, and where sharp objects can cut the lines.

The breaking strengths of braided lines commonly well exceeds their pound-test ratings. Braided lines often have one-quarter to one-third the diameter of monofilament and fluorocarbon lines at a given test breaking strength. It is therefore easier to fit much longer line on a standard spool. This can be very important in deep sea fishing, since the reels needn't be big to accommodate the long lines. And the thinner braided lines provide resist sea currents better.

Braided fishing lines are also very soft and flexible, making them easy to cast long distances. Braided lines usually float, and so are common choice for top-water rigs. Braided lines have practically no stretch, which makes fishing rigs very sensitive to fish bites. This can be very important in deep sea fishing, and for catching fish that are very gentle with the bait when feeding. But, hard hitting fish can break braided lines with first strike.

One serious drawback of braided lines in fishing is they are highly visible to fish. And so, it is common to attach a fluorocarbon monofilament leader line at the distal end.

The flexibility, lack of stretch and slippery surfaces also make braided lines hard to knot. So special knots like the Palomar, Berkley Braid, San Diego Jam, Trilene, and Albright knots need to be used. It is important to tie the knots carefully. In order to prevent knots from slipping, some fishermen add a drop of super glue.

Braided lines, particularly those made of the newer synthetics, are excellent lines for bait casting, in particular for trolling and are especially popular with fishermen.

Various kinds of metal materials can be used in metal wires 102A (FIG. 1A), 102B (FIG. 1B), 102C (FIG. 1C), and 202 (FIG. 2). Particular metals are believed to have medicinal purposes, like copper. E.g., Copper bracelets are widely worn by arthritis and joint pain sufferers for pain relief.

There were seven metals in the ancient alchemical system of healing: gold, silver, mercury, copper, iron, tin, and lead. (Mercury itself cannot be made into wire, because it's normally a liquid, and even modest exposures to mercury or lead have proved to be poisonous.)

Metals are universally good electrical conductors, and make for good electrical connections in circuits. Metal wires can also make excellent radio antennas and leads. A simple section of wire passed through a hole in an outside wall of a collapsed building can couple radio communications between transceivers on the inside and the outside.

Various kinds of metal like copper, brass, aluminum, silver, stainless steel, and iron, can be easily made into wire and each kind has its own useful properties. Gold and stainless steel do not corrode. Gold and copper wires are very flexible and good electrical conductors. Lead wire can be used as a solder. Stainless steel wire could be used to hang food for cooking in fires. Of all the choices, copper wire seems to have the most appeal and usefulness to users of embodiments of the present invention.

A continuous copper wire can be employed to serve as an electric burner or igniter if a small battery is available. Metal wire 202 is alloyed and sized in such case to have an electrical resistance in a range that will heat to an ignition temperature for cellulose when less than 12" of its length is connected to a battery less than or nominally equal to 12-volts. The heating effects can be concentrated at a center point by doubling or tripling up the wire by folding and twisting so that only a single strand bridges the midsection. Such would also make connecting the battery safer because the leads would not get so hot.

Fluorocarbon monofilament fishing line works best in clear water situations or when "line stretch" is undesirable. Very little stretch transmits fish strikes better and allows for stronger hook-sets. Fluorocarbon monofilaments have the best abrasion resistance, but tend to have problems with memory and "stiffness". They are not cheap, and many use it as a leader material. And so the braided fishing line 212 is preferred in this embodiment.

For Jute twine 214, a string diameter of about 1-2 millimeters seems to provide enough material that it can be scraped, flattened, roughed up, and succeed as tinder without adding too much bulk to 555-Paracord 100. Jute twine is essentially cellulose and is biodegradable, however it can promote and feed molds and mildew if wet. Jute twine is also photochemical degradable when exposed to ultraviolet. Jute twine burns because cell wall polymers undergo pyrolysis reactions and give off flammable gases. Biological resistance can be added by using wood preservatives or by keeping moisture content low, a side benefit of waterproofing it with paraffin wax.

In most cases, the goal is to keep the cord pliable so that it can be easily used in crafts. If 555-Paracord 100 was permitted to get so large as to be unmanageable, no one would use it in their survival crafts. In such case it won't be available in a survival situation.

Improved 550-Paracord embodiments of the present invention provide the basic materials needed for ingenious use by resourceful adventurers to catch fish to cook and eat for survival. Many kinds of fishing methods from rod-and-reel, to fly fishing, to netting, and snaring are known and have been successfully used for thousands of years. These embodiments allow for fast immediate use without undue preparation of the basic gear.

Fly fishing gear setup includes the fly rod, fly reel, fly line, and flies. The fly fishing leader and tippet provide a nearly invisible transition from the fly line to the fly. Fly fishing leaders and tippets come in a wide variety of shapes, sizes, materials, and even colors. A main purpose of the leader and tippet is to connect thick, colored fly lines used for casting to the flies that are presented to the fish, using a material that won't scare them away. They further complete a transfer of energy in the fly line through the casting stroke through the line and down to the fly so that the line rolls over and straightens itself out into a straight line.

Commercial leader and tippet manufacturers have produced a wide assortment of products. There is a difference between fly fishing leaders and tippets. The clear material of the leader is connected to the end of the fly line and is a fairly heavy weight where it attaches. It often will taper down in weight and thickness to a point for the tippet to attach. The leader is pretty much the same as fishing monofilament used on spinning and casting reels.

The section of the leader that attaches to the fly line is generally on the heavy side of the pound test rating, and is called the butt section. Many anglers start with a twenty pound test butt section of leader to attach to the fly line, and taper down to around four pound test. The leader, on average, will be about nine feet long.

The fly fishing tippet is the lightweight portion of material that is attached to the fly. The lightest, yet strongest, tippet possible is required to keep the fish from noticing it. Generally the same leader section can be used with changes to the tippet size, depending on the nature of the fishing and the situation.

The typical length to use when learning how to fly fish is around ten feet. The goal with a leader setup is to create a taper from the butt section down to an as-thin-as-possible tippet section. Such allows the energy from the fly line to transfer as efficiently as possible through the leader and tippet to straighten out as the cast lands on the water surface.

Starting out with a twenty pound test leader material attached to the fly line and tapering down, the last couple feet of material will have the tippet attached. This arrangement provides the best way to deceive fish that anything is attached to the fly.

Several people have publically suggested on the Internet ways to make the fishing flies themselves out of paracord. Flies are a necessity when no bait is available. But all these clever suggestions seem to require a fishing hook. A solid copper wire can be used to fashion a suitable fishing hook, certainly for smaller fish.

Dissimilar materials and filaments in the kern will have different elasticity and stretch. This is not expected to be of any concern with the short lengths involved with survival bracelets where there is no stress ever applied. Its first use would normally to pull it apart to cannibalize the constituent filaments in the kern.

FIGS. 3A and 3B represent a survivalist's kernmantle bracelet 300 in an embodiment of the present invention. It is intended to be worn in the field around a user's wrist 302. Such survivalist's kernmantle bracelet is looped, knotted, tied, and otherwise woven from a single piece of kernmantle cord 100A, 100B, 100C (FIGS. 1A, 1B, 1C) and 200 (FIG. 2). A safety catch, comprising front and rear clasps 304A and 304B, and more described in another US Patent Application of ours, may be included to join together end-attachments 306A and 306B around the user's wrist 302. Such safety catch will release automatically if pulled on with enough force to threaten injury to the user or their wrist 302. See, U.S. patent application Ser. No. 15/207,532, filed Jul. 12, 2016.

In general, mantle/sheath outside diameters in embodiments of the present invention are within the range of 4-5 mm. The number of sheathing threads are within a so-called Type-III range of 32-36 total to help create a tighter bundle around the kern at the core.

Metal wires 102A, 102B, 102C, and 202 can be advantageously coated with plastic or silicone jackets, e.g., especially to control breakage and any tendency for broken wire ends to pierce outside through the mantles. Other reasons are to approximate a Litz wire construction for radio frequency applications.

Our preferred embodiments have changed over time as we gain more experience and customers report their needs back to us. Metal wires 102A, 102B, 102C, and 202 have changed in our preferences from copper to brass, and then from brass to stainless steel to increase sturdiness and reduce breakage.

Ongoing experiments are being conducted with braided strand metal wire 102C (FIG. 1C) that focuses on a rough 30 AWG total diameter. We hope such will help to reduce wire protrusions that have occurred occasionally in manufacturing and product delivery.

In one embodiment of the present invention, the size of the monofilament fishing line 212 (FIG. 2) is reduced to a breaking strength of 8-10 lbs mitigate the overall weight and diameter. For example, Berkeley TRILENE XT®. PowerPro Spectra® Braided 10 pound test Fishing Line is an acceptable choice for braided fishing line 212 (FIG. 2).

A change from monofilament to braided fishing line allows for larger/heavier fish to be targeted, and braided fishing line has a dual purpose of being a good medical suture thread.

We changed from wax-soaking the Jute twine to impregnating the Jute with Paraffin wax to improve its overall water-resistance.

Medical sutures come in monofilament and braided types. Monofilament sutures of any given material cause less of a biologic reaction than do braided sutures. But monofilaments need more ties per inch to assure an adequate maintenance of the knots compared to braided sutures. Monofilament sutures are usually non-absorbable. Although braided sutures incite a greater inflammatory response, they require fewer ties to maintain the knot integrity. These include silk, cotton and Mersilene.

The strength of suture materials varies according to their diameters, and is rated by a uniformly applied number. For example, a 6-0 suture is more delicate and has less strength than a 4-0 suture would.

Sutures come as either absorbable or non absorbable. Absorbable sutures are made of materials which will decompose in tissue over time, which can be from ten days to eight weeks. Absorbable sutures are used therefore to close many of the internal tissues of the body. In most cases, three weeks is sufficient time for a wound to close firmly. After that the suture is not needed any more. The fact that it decomposes is an advantage, as there is no foreign material left inside the body, and no need go back in and remove the sutures.

Absorbable sutures were originally made of the intestines of sheep, so called catgut. However, the majority of absorbable sutures are now made of synthetic polymer fibers, which may be braided or monofilament. These offer numerous advantages over gut sutures, notably ease of handling, low cost, low tissue reaction, consistent performance and guaranteed non-toxicity.

Naturally absorbable sutures include plain catgut, chromic catgut, synthetic absorbable polyglycolic acid, Vicryl, PGA coated and braided, Polyglactin 910, PGLA coated and braided, Poliglecaprone sutures (Monocryl), PGCL monofilament, Polydioxanone (PDS) monofilament.

Non absorbable sutures are those made of materials are not metabolized by the body, and so are used either on skin wound closure, where the sutures can be removed after a few weeks. And also in some inner tissues in which absorbable sutures are not adequate. This is the case, for example, in the heart and in blood vessels, whose rhythmic movement requires a suture which stays longer than three weeks, to give the wound enough time to close. Other organs, like the bladder, contain fluids which make absorbable sutures disappear in only a few days, too early for the wound to heal. There are several materials used for non absorbable sutures. The most common are natural fiber and silk, which is specially processed in manufacturing to make it adequate for its use in surgery. Other non-absorbable sutures are made of artificial fibers, like polypropylene, polyester or nylon. These can have coatings to enhance their performance characteristics. Stainless steel wires too are commonly used in orthopedic surgery, and sternal closure in cardiac surgery.

FIG. 4 represents a wired kernmantle cord embodiment of the present invention, and is referred to herein by the general reference numeral 400. A metal wire 402 is sleeved by a plastic coating 403 and both are disposed coaxially in the center of a kern 404 of seven synthetic yarns 411-417. The plastic coating 403 controls and limits mechanical excursions of any broken ends of wire 402 within from reaching through or outside a woven mantle 406.

Each yarn 411-417 comprises three twisted synthetic fibers 421-423. The kern 404 is environmentally protected by the woven nylon mantle 406. The mantle 406 provides both abrasion resistance, and electrical insulation for the metal wire. It being woven allows the mantle to be very flexible, to the point of being floppy with no "memory" and no tendency to retain kinks.

Nylon was, of course, the original synthetic fiber material in 550-Paracord (MIL-STD-C-5040H Type III). Very acceptable alternative synthetic fibers include polyester, Dyneema®, ultra-high-molecular-weight polyethylene (UHMWPE, UHMW), and thermoplastic polyethylene. These can all look and perform very much like nylon. More, or fewer, yarns and threads within each of the yarns can also be used, depending on the cord strength needed and the girths that can be tolerated. The numbers and types of materials disclosed here represent what is believed to be optimum in terms of use and manufacturability.

Although the present invention has been described in terms of the presently preferred embodiments, it is to be understood that the disclosure is not to be interpreted as limiting. Various alterations and modifications no doubt become apparent to those skilled in the art after having read the above disclosure. Accordingly, it is intended that the appended claims be interpreted as covering all alterations and modifications as fall within the "true" spirit and scope of the invention.

What is claimed is:

1. A wired kernmantle cord, comprising:

a single continuous length of solid, stranded, or braided metal wire placed in the center of the wired kernmantle cord;

a bundle of synthetic yarns that surround the metal wire and that each comprise twisted synthetic fibers;

wherein the metal wire and the yarns assembled together constitute a kern;

a pliable outer mantle that surrounds and sheathes the kern inside, and that is formed of a woven or otherwise braided covering of synthetic fibers;

wherein, the pliable outer mantle provides environmental protection from weather and abrasion of the kern as a whole, and electrical insulation for the metal wire; and wherein the pliable outer mantle comprises nylon and is woven densely and tightly enough to prevent any of the kern from appearing or working through.

2. The wired kernmantle cord of claim 1, further comprising:

a braided fishing line included in the full length of the kern.

3. The wired kernmantle cord of claim 1, further comprising:

a Paraffin-waxed Jute twine included in the full length of the kern.

4. A wired kernmantle cord, comprising:

a single continuous length of stranded metal wire placed in the center, and that is a multi-strand of at least seven strands, with one strand in the middle, and six strands surrounding it in close contact;

a bundle of seven nylon yarns that surround the metal wire and that each comprise three twisted nylon fibers;

wherein the metal wire and the seven yarns together constitute a kern;

a pliable outer mantle that surrounds and sheathes the kern inside, and that is formed of a woven or otherwise braided covering of nylon, wherein such provides environmental protection from weather and abrasion of the kern as a whole, and electrical insulation for the metal wire at its coaxial center;

wherein, the pliable outer mantle is woven densely and tightly enough to prevent any of the kern from appearing or working through;

a braided fishing line included in the kern; and a Paraffin-waxed Jute twine included in the kern.

5. The wired kernmantle cord of claim 4, wherein:

the metal wire is a multi-strand of nineteen strands, which is another layer of twelve strands on top of the first seven.

6. A wired kernmantle cord, comprising:

a single continuous length of solid, stranded, or braided metal wire placed in the center of the wired kernmantle cord;

a bundle of synthetic yarns that surround the metal wire and that each comprise twisted synthetic fibers;

wherein the metal wire and the yarns assembled together constitute a kern;

a pliable outer mantle that surrounds and sheathes the kern inside, and that is formed of a woven or otherwise braided covering of synthetic fibers;

wherein, the pliable outer mantle provides environmental protection from weather and abrasion of the kern as a whole, and electrical insulation for the metal wire; and a plastic coating that sleeves the metal wire, and is such that any mechanical excursions of any broken ends of metal wire within are controlled and limited from reaching through or outside the pliable outer mantle.

* * * * *